US010463068B2

(12) United States Patent
Soo et al.

(10) Patent No.: US 10,463,068 B2
(45) Date of Patent: Nov. 5, 2019

(54) CASTING APPARATUS FOR THE PRODUCTION OF A CAST WEB OF HOMOGENIZED TOBACCO MATERIAL

(71) Applicant: PHILIP MORRIS PRODUCTS S.A., Neuchatel (CH)

(72) Inventors: Siew Hock Soo, St-Sulpice (CH); Fabio Conti, Albairate (IT); Raffaele Pozzi, Limbiate (IT); Yorick Klipfel, St-Saphorin-sur-Morges (CH)

(73) Assignee: Philip Morris Products S.A., Neuchatel (CH)

( * ) Notice: Subject to any disclaimer, the term of this patent is extended or adjusted under 35 U.S.C. 154(b) by 106 days.

(21) Appl. No.: 15/527,156

(22) PCT Filed: Dec. 16, 2015

(86) PCT No.: PCT/EP2015/079961
§ 371 (c)(1),
(2) Date: May 16, 2017

(87) PCT Pub. No.: WO2016/096963
PCT Pub. Date: Jun. 23, 2016

(65) Prior Publication Data

US 2017/0340002 A1 Nov. 30, 2017

(30) Foreign Application Priority Data

Dec. 16, 2014 (EP) ..... 14198173

(51) Int. Cl.
*A24B 3/14* (2006.01)
*A24B 15/12* (2006.01)

(52) U.S. Cl.
CPC ..... *A24B 3/14* (2013.01); *A24B 15/12* (2013.01)

(58) Field of Classification Search
None
See application file for complete search history.

(56) References Cited

U.S. PATENT DOCUMENTS 2,769,734 A 11/1956 Bandel
3,261,893 A * 7/1966 Everett ..... B29C 48/30 264/40.5

(Continued)

FOREIGN PATENT DOCUMENTS

CN 1173418 2/1998
CN 2287700 8/1998

(Continued)

OTHER PUBLICATIONS

International Search Report and Written Opinion for PCT/EP2015/079961 dated Mar. 17, 2016 (10 pages).

(Continued)

*Primary Examiner* — Dennis R Cordray
(74) *Attorney, Agent, or Firm* — Mueting, Raasch & Gebhardt, P.A.

(57) ABSTRACT

The present invention is relative to a casting apparatus for the production of a cast web of homogenized tobacco material, said casting apparatus comprising •a casting box adapted to contain a slurry of said homogenized tobacco material; •a movable support; •a casting blade adapted to cast said slurry contained in said casting box onto said movable support in order to form the cast web; •wherein said casting apparatus further comprises a first, a second and a third actuator coupled to said casting blade in a first, a second and third position, respectively, said first, second and third actuator being suitable to change a distance between said casting blade and said movable support in said first, second and third position, respectively.

16 Claims, 9 Drawing Sheets

(56) References Cited

U.S. PATENT DOCUMENTS

| | | | | |
|---|---|---|---|---|
| 4,337,783 | A | 7/1982 | Hooper | |
| 5,697,385 | A | 12/1997 | Seymour | |
| 2003/0209027 | A1* | 11/2003 | Owens | A01J 25/12<br>62/342 |
| 2011/0220135 | A1 | 9/2011 | Wrenn | |
| 2014/0216676 | A1* | 8/2014 | Gauss | D21F 1/486<br>162/348 |

FOREIGN PATENT DOCUMENTS

| | | |
|---|---|---|
| CN | 102326862 | 1/2012 |
| CN | 202985901 | 6/2013 |

OTHER PUBLICATIONS

Office Action issued in China for Application No. 201580065934.6 dated Feb. 26, 2018 (8 pages). English translation included.

* cited by examiner

CASTING APPARATUS FOR THE PRODUCTION OF A CAST WEB OF HOMOGENIZED TOBACCO MATERIAL

This application is a U.S. National Stage Application of International Application No. PCT/EP2015/079961, filed Dec. 16, 2015, which was published in English on Jun. 23, 2016, as International Publication No. WO 2016/096963 A1. International Application No. PCT/EP2015/079961 claims priority to European Application No. 14198173.8 filed Dec. 16, 2014.

This invention relates to a casting apparatus for producing a cast web of homogenized tobacco material. In particular, the invention relates to a casting apparatus for producing a cast web of homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for example for the control of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of webs of homogenized tobacco. A less than optimal casting method and apparatus may lead to inhomogeneity and defects of the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing of the web or even rupture of the web during manufacture of the web of homogenised tobacco or further processing of the web of homogenised tobacco. This in turn could, for example, result in machine stops and the inadvertent creation of waste. Additionally, an inhomogeneous tobacco web may create unintended difference in the aerosol delivery between aerosol generating articles that are produced from the same homogenized tobacco web.

There is therefore a need for a new casting apparatus of preparing a homogenized tobacco material, in particular for the use in a heated aerosol-generating article of the "heat-not-burn" type that is adapted to the heating characteristics and aerosol forming needs of such a heated aerosol-generating article.

According to a first aspect, the invention relates to a casting apparatus for the production of a cast web of homogenized tobacco material, said casting apparatus comprising a casting box adapted to contain a slurry of said homogenized tobacco material; a movable support; and a casting blade adapted to cast said slurry contained in said casting box onto said movable support in order to form the cast web. According to the invention, the casting apparatus further comprises a first, a second and a third actuator coupled to said casting blade in a first, a second and third position, respectively, said first, second and third actuator being suitable to change a distance between said casting blade and said movable support in said first, second and third position, respectively.

Homogenized tobacco materials are formed by mixing several ingredients with water to obtain a slurry. In a further step, a continuous web of homogenized material is created on a support by casting the slurry onto the support. It is desired that the resulting homogenized tobacco material has a relatively high tensile strength and a good homogeneity.

An important parameter of the slurry which is used to realize the homogenized tobacco material and which influences the tensile strength and homogeneity of the cast web is its viscosity to form the continuous web of homogenized tobacco material, in particular at the time of casting of the slurry. In addition, also the density of the slurry is important for determining the end quality of the cast web, in particular before casting. A proper slurry density, viscosity and homogeneity minimize the number of defects and maximize tensile strength of the cast web.

The slurry comprises a number of different components or ingredients. These components influence the homogenized tobacco material properties. A first ingredient is a tobacco powder blend, which preferably contains the majority of the tobacco present in the slurry. The tobacco powder blend is the source of the majority of tobacco in the homogenized tobacco material and thus gives the flavor to the final product, for example to an aerosol produced heating the homogenized tobacco material. A cellulose pulp containing cellulose fibers is preferably added to the slurry in order to increase the tensile strength of the tobacco material web, acting as a strengthening agent. A binder and an aerosol-former are preferably added as well, in order to enhance the tensile properties of the homogenized sheet and promote the formation of aerosol. Further, in order to reach a certain viscosity and moisture optimal for casting the web of homogenized tobacco material, water may be added to the slurry. The slurry is mixed in order to render the slurry as homogeneous as possible.

The slurry is then collected in a casting box, in which a pre-defined amount of slurry is preferably maintained, for example a pre-determined filling level of slurry within the casting box is set. Preferably, slurry is continuously supplied to the casting box while the slurry is cast onto a movable support to form a continuous web of homogenized tobacco material.

According to the invention, the slurry is cast across a width of a moving support, through an exit of the casting box that is formed between the moving support and a casting blade. The support moves along a longitudinal direction in order to remove the slurry from the casting box. The support may include for example a stainless steel movable belt. The casting blade is used in order to form a cast web of slurry which has a substantially uniform thickness onto the movable support. Further, the distance or gap between the blade and the support determines the thickness of the cast web of slurry.

The thickness of the web of homogenized tobacco material which is cast onto the movable belt has a preferred value which is as uniform as possible across the width of the cast web in order to obtain a final product within the required specifications. In order to achieve such homogeneous thickness, according to the invention, the gap present between the casting blade and the movable support is adjustable. Preferably, it is locally adjustable, that is, the casting blade can vary its distance from the movable support locally, not only as a whole. Therefore, irregularities in the casting blade and in the movable support can be compensated. Advantageously, according to the invention, the distance between the blade and the support can be changed locally where the irregularity is. This local change can be obtained by three actuators, which can preferably be independently regulated, coupled to the casting blade. In this way, both an optimal casting and a good control of the blade positioning can be achieved.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering for example tobacco leaf lamina or tobacco leaf stems or blends thereof.

In addition, homogenized tobacco material may comprise a minor quantity of one or more of tobacco dust, tobacco fines, and other particulate tobacco by-products formed during the treating, handling and shipping of tobacco.

In the present invention, the slurry is preferably formed by tobacco lamina and stem of different tobacco types, which are properly blended. In this, the term "tobacco type" refers to one of the different varieties of tobacco. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

As mentioned above, the slurry should be as homogeneous as possible so that also its viscosity is as uniform as possible and close to a target value optimal for casting. In order to obtain a uniform viscosity, the entire amount of slurry is preferably mixed before casting.

The slurry is then transported to the casting box to fill the casting box up to a preferably pre-determined level. Preferably, the filling level of slurry in the casting box is maintained substantially constant within the casting box. The slurry flows out the casting box from an aperture realized in the bottom of the casting box, for example under the influence of by gravity. Additionally, means for an active transport within the casting box may be provided, like pushers or propellers. Preferably, the casting box forms a pressurized enclosure. Preferably, control means are provided that allow control over the pressure within the casting box. In such an embodiment, the flow of slurry out of the casting box is additionally controlled by setting and maintaining the level of the internal pressure within the casting box. Preferably, the casting apparatus comprises a mixing device to mix the slurry inside the casting box. The slurry is then distributed onto the movable support through the gap that is formed between the casting blade and the moving support.

The casting blade has a dominant dimension, which is its width, and it preferably extends along substantially the whole width of the casting box. Preferably, the width of the blade and the width of the casting box to which the blade is attached are similar. Across the width of the casting blade, the first, second and third actuator are disposed. According to the invention, the first, second and third actuator are coupled to the casting blade itself, for example by means of fastening means, in a first, second and third position, respectively. The coupling between the casting box and the casting blade is such that the casting blade is movable with respect to the casting box, for example by means of one, two or all of the first, second or third actuator. In the present invention, at least three actuators are present; however additional actuators that are coupled to the casting blade to change the dimension of the distance between casting blade and movable support may be provided.

The change in the gap dimension is therefore performed changing the spatial positioning, that is the position in the tridimensional space, of the casting blade by means of the three actuators. The spatial position of the support is considered to remain substantially constant; however a position change of the support is not excluded. The change of the dimension of the gap can be uniform, which means that all actuators move the blade of the same amount, or non-uniform, where the actuators may displace the blade by different distances. This non-uniform actuation for example includes the case in which only one or only two actuators out of the three actuators present are operated and the other(s) remain still. For example, in an embodiment, the first and second actuators are non-operated, and only the third actuator is controlled to move the spatial positioning of the blade at the third position. The spatial positioning of the casting blade in the first and second position does not change and the dimension of the gap at the first and second position does not change as well or it changes only of a relatively small amount compared to the change at the third position. Further, a non-uniform actuation of the actuators encompasses any other displacement of the casting blade wherein at least one of the three actuators is displaced by a different distance or in a different direction than the other actuators.

The thickness of the cast web is an important parameter to obtain the desired characteristics and the quality in the finished product, for example, an aerosol-generating article. The thickness of the cast web is determined, among others, by the dimension of the distance, or gap, present between the casting blade and the movable support. This gap can be identified as follows. The aperture in the bottom of the casting box allows the slurry to flow onto the movable support. The movable support transports the slurry away from the casting blade, thereby forming a continuous cast web on the movable support. The thickness of the web of homogenous material depends, among other parameters, on the dimension of the distance present between the upper surface of the movable support where the slurry is attached to and the lowermost surface of the casting blade. Further parameters are the density of the slurry, the temperature of the slurry and the filling level of the slurry in the casting box, the thickness of the cast web. Where the cast web of homogenized tobacco is "thick", the cast web is more likely to attract defects, such as the so called "draggers", or agglomerates. On the other side, a "thin" cast web is more likely to crack, potentially causing interruptions in the manufacturing process. Consequently, the gap between the casting blade and the movable support has to be adequately controlled to maintain the balance between a "thick" web and a "thin" web in the area of the casting blade.

Further, the cast web may have a different preferred thickness depending on the specific values of the process parameters, such as for example the viscosity of the slurry, the temperature of the same and the type of constituents of the slurry itself. Therefore, in case these parameters are changed between a production batch and a subsequent one, the dimension of the gap between the casting blade and the moving support may need to be changed as well in order to adapt to the new process parameters.

A change in the process parameters between one batch and a subsequent one without a change in the gap dimension may also lead to a change in the final thickness of the cast web. Therefore, the dimension of the gap may need to be changed in order to keep the thickness of the cast web the same. In addition, in some applications, the viscosity of the slurry is time dependent, that is, the viscosity of the slurry changes over time. This is particularly so where the slurry comprises film forming components like for example a binder that forms a gel when in contact with water, thus increasing the viscosity. Advantageously, according to the invention, the gap between the casting blade and the movable support may be controlled as a function of time to accommodate changing production parameters. This allows for the continuous production of a homogenous tobacco material web with little waste.

Further, a cast web having a constant thickness is also relevant in the drying process. After the casting, the web of homogenized tobacco material is dried and the drying parameters depend, among others, on the thickness of the web. If the cast web includes thickness variations, changes in the moisture content may appear in finished product, and this may require at least partial rejection of the end product.

The invention thus allows changing the gap dimension easily and in different ways by means of three actuators. The actuators that are connected to the casting blade in different positions advantageously allow many ways of altering and controlling the dimension of the gap distance between the casting blade and the movable support. The three actuators, located in three different positions, can change the dimension of the gap locally, that is to say that the first actuator can change the dimension of the gap in the neighborhood of the first position, the second actuator can change the dimension of the gap in the neighborhood of the second position and the third actuator can change the dimension of the gap in the neighborhood of the third position. The changes in the gap dimension can be therefore tailored to the specific local need. In particular, the three actuators may change the spatial position of the casting blade in a uniform way or a non-uniform way. In the uniform way, all three actuators move the casting blade by the same amount in the same direction. The non-uniform movement of the casting blade comprises all other displacements of the casting blade where at least one of the actuators displaces the casting blade locally by an amount or a direction that it different from at least one other actuator. A movement of all three actuators of the same amount and in the same direction results in a displacement of the casting blade to create gap that is either increased or reduced. The presence of three actuators along the longitudinal width of the casting blade, for example one actuator at each end of the blade and one in between, has the advantage over a two actuator system, that the casting blade can be bent into a curved form. A further advantage of a three actuator system is that distance between the supporting points of the casting blade is narrower than for a two actuator system. This reduces the intrinsic deformation of the casting blade by gravitational forces—in particular in case of relatively long blades. This further improves the homogeneity of the continuous web of tobacco material.

The non-uniform displacement of the actuators can create different shapes of the casting blade. For example a wedge-like gap or a curved gap can be obtained with the three actuators. As mentioned, the blade or the support may include a non-uniform surface in contact with the slurry, due to misalignments or defects in the manufacturing of these elements. In order to compensate for the misalignment, or for other inhomogeneity due to other causes, a gap having a non-uniform dimension can be desired. For example, a wedge-like gap can be created, where the distance between the blade and the support is different from one longitudinal end to the opposite other longitudinal end of the casting blade. This wedge-like shape can be obtained operating the three actuators so that the casting blade is moved by different distances, for example in a vertical direction. Alternatively, one may stay immobile and only one or two of the other actuators locally displace the casting blade. A curved gap can be selected and realized as well, which means that the blade is not rectilinear but is in a curved configuration. A curved casting blade can be obtained by actuating only the actuator that is located between the first actuator and the second actuator. Alternatively, all three actuators may be operated, but displaced by different distances so that their three end positions are not located along a straight line, but can be connected only by a curve, either concave or convex.

Preferably, at least one of said first, second and third actuator is a linear actuator. Preferably, the casting blade is moved substantially in a linear, vertical direction. However, the displacement may also be translated into a circular, curved or other motion path, if needed. A non-linear displacement movement can be for example created by using appropriate levers or cams.

In addition, the blade may be in operational engagement with an ultrasonic actuator that permits the blade to vibrate in a set frequency, within a range of frequencies or at a certain time dependent frequency, that is, a frequency that regularly or randomly alternates within a range of frequencies. This may clean the blade and remove the risk of fibers or other material adhering to the blade. Material adhering to the blade may cause so called "draggers" that in turn can create inconsistencies in the continuous homogeneous tobacco material.

Advantageously, said first, second and third actuator are so configured that they can be actuated to change the distance between said casting blade and said movable support in said first, second and third position, respectively, independently one from the others. In this way, the actuators can force the blade to be positioned according to a large number of different pre-defined shape or spatial location. A very high freedom in positioning the blade is achieved, which in turn allows for a high accuracy in the final thickness of the cast continuous web of homogenized tobacco material.

According to a preferred embodiment, said first and second position are located at a first and at a second longitudinal end of said casting blade, respectively, and said third position is located in between said first and second longitudinal end of said casting blade. The configuration in which the three actuators are substantially evenly distributed along the longitudinal width of the blade allows a good flexibility in the positioning of the blade and at the same time minimizes the possibility of undesired deformations of the blade due to gravity because the blade is supported in a manner in which the weight of the blade is substantially evenly distributed.

Preferably, the apparatus according to the invention comprises transverse displacement means that allow displacing at least one of the first, second or third position of said first, second or third actuator along said casting blade. In this way, not only the distance between the blade and the support can be changed, but also the distance between the actuators themselves can be varied. This further improves the degree of flexibility of the apparatus according to the invention to adapt to different or changing process parameters.

In an advantageous embodiment, the casting apparatus of the invention further comprises a plurality of fine adjustment elements coupled to said casting blade, each fine adjustment element being adapted to locally vary the distance between said casting blade and said movable support. According to the invention, the fine adjustment elements are located along a longitudinal width of said casting blade. For example, a fine adjustment element is provided at about every 5 cm to about every 15 cm. Preferably, at least one of said fine adjustment element is adapted to locally vary the distance between said casting blade and said movable support of a value comprised between about 1 μm and about 200 μm. The adjustment elements advantageously allow for compensation of intrinsic manufacturing imprecisions of the casting blade as well as of the movable support, for example a stainless steel belt, and of local wear of the casting blade as well as of the movable support, that can happen over time.

The positioning of the casting blade with respect to the movable support is preferably a two-steps process. In a first step, typically taking place before the casting process has started, a regulation of the blade positioning by means of the fine adjustment elements is made, in order to regulate the position of the blade with respect to the support, in order to set an initial gap dimension. The initial regulation takes into account the forms and defects of the blade and support themselves. The second adjustment of the blade positioning is performed by controlling the three actuators to reach the optimal dimension and configuration of the gap, after the casting step has started and the characteristics of the cast web and the slurry have been measured. Preferably, the second adjustment is continuous or semi-continuous throughout the entire production process.

Advantageously, said fine adjusting elements comprise screws which are adapted to, when screwed or unscrewed, locally lower or rise said casting blade with respect to said movable support, respectively. This allows an easy operation of the fine adjustment elements.

Preferably, the casting apparatus further comprises a sensor, and a control unit adapted to send signals to or receive signals from said sensor and to send signals to or receive signals from said first, second and third actuators, said sensor being adapted to detect a parameter of said cast web or of said slurry and send a corresponding signal to said control unit which in turn is adapted to send a command signal to said first, second or third actuator to operate the respective first, second and third actuators.

Preferably, the casting apparatus comprises a control unit and one or more sensors adapted to send signals to said control unit, said one or more sensors comprising at least one of a sensor to identify draggers on the cast web cast on the movable support; a sensor to determine the moisture of said cast web cast on the movable support; a sensor to measure the thickness or variations in thickness of said cast web cast on the movable support; a sensor to measure the viscosity of the slurry in said casting box; a sensor to measure the temperature of said slurry in said casting box; a sensor to detect the position of defects on said cast web cast on the movable support; a sensor to detect the density of the slurry in said casting box; and combinations of two or more of the above sensors.

The formation of the slurry is a delicate process which determines the quality of the end product. Several parameters may be controlled to minimize the risk of a rejection of the homogenized tobacco web obtained by casting the slurry prepared according to the invention. These process parameters are—among others—, the temperature of the slurry, the temperature of the casting box, the temperature of the movable support, the moisture content of the slurry, the residence time or age of the slurry and the viscosity of the slurry. It is known that the viscosity is indeed a function of the temperature, the moisture and the age of the slurry, for example due to a continuous gelling of a film forming substance within the slurry. Therefore, preferably, at least one of the viscosity, the temperature and the moisture content of the slurry is monitored with appropriate sensors. Preferably, the sensor signals are used with a feedback loop for online signal processing and control to maintain the parameters within a set of predetermined ranges. For example, the process control may be influenced by appropriate process parameter changes, such as the amount of cooling of the slurry, cooling of the casting box, the temperature of the slurry, the temperature of the casting box, the temperature of the movable support, the temperature profile along the width of the cast web, the speed of the movable support, the amount of water introduced in the slurry, the amount of other compounds forming the slurry, combinations of the aforementioned process parameter changes and other parameters.

Preferably, the moisture of said cast tobacco material web at casting is between about 60 percent and about 80 percent. Preferably, the method for production of a homogenized tobacco material comprises the step of drying said cast web and winding said cast web after drying. Preferably, the moisture of said cast web at winding is between about 7 percent and about 15 percent of dry weight of the tobacco material web. Preferably, the moisture of said homogenized tobacco web at winding is between about 8 percent and about 12 percent of dry weight of the homogenized tobacco web. The moisture of the slurry at casting is another important parameter to control which influences the homogeneity of the homogenized tobacco web and the manufacturability of the homogenized tobacco web in subsequent production steps.

The density of the slurry, in particular before a step of casting the slurry to form a homogenized tobacco web, is important for determining the end quality of the web of homogenized tobacco material. A homogenous density of the slurry minimizes the number of defects and increases the tensile strength across the web of homogenized tobacco material.

Advantageously, the control unit is adapted to command the first, second or third actuator in response to a signal received from one or more of said sensors in order to perform a feedback loop to vary one or more of the parameters detected by said one or more sensors in response to said signal.

Preferably, one or more feedback loops are present in the casting apparatus of the invention. The presence of defects, for example of the draggers, and inhomogeneity in the thickness of the web of homogenized tobacco material implicitly indicate the presence of non-optimal casting conditions. These non-optimal casting conditions can be due to several factors, such as the density of the slurry outside of a preferred range, a non-uniform gap between the casting blade and the movable support across the width of the casting blade, a level of moisture in the slurry outside of a preferred moisture range and others. Therefore, advantageously a plurality of sensors is used in order to obtain values of parameters which play a role in the casting process. These values can then in turn be adjusted with the feedback loops, for example when the conditions of the casting would cause the production of cast web to be outside of the desired specifications. The appearance of defects or non-uniformities or the displacement of a parameter outside a standard pre-set range is detected by one or more sensors and a corresponding signal is sent to the central control unit. The central control unit may operate an actuator in order to change the deviating process parameter or to modify one or more additional different parameters to correct the detected problem. Preferably, the location of the defects in the web is recorded and used for subsequent rejection of the defect areas of the homogenized tobacco material.

In an advantageous embodiment, said casting blade has a transverse cross section defining a blade edge, said blade edge comprising a first arc of circumference having a first radius of curvature and a second arc of circumference having a second radius of curvature or said blade edge comprising a portion of an ellipse.

The casting blade has a main dimension, which is its width, and it preferably extends along substantially the whole width of the casting box. Preferably, the width of the blade and the width of the casting box to which the blade is attached are similar. A section of the casting blade taken by means of a plane substantially perpendicular to the width direction of the blade defines a blade edge (in Cartesian coordinates X,Y,Z the sectioning plane is a (X, Z) plane, wherein X is in the direction of travel of the slurry in the movable support, Y being the direction of the width of the casting blade and Z is the vertical direction). The blade edge follows a given curve in the section plane (X, Z). In the blade edge, at least two points are considered that do not belong to the extremities of the edge, that is, which are not taken at the beginning or at the end of the edge where the blade starts or terminates or it is connected to the casting box. In these two points, the mathematical curve defined by the blade edge is preferably continuous and has a continuous first derivative.

These two different points of the section, called first point and second point, have a different radius of curvature. In this context, the term "different points" means that at least one of the coordinates ($X_1$, $Z_1$) of the first point is different from one of the coordinates of the second point ($X_2$, $Z_2$). Thus, the radius of curvature of the blade edge at the first point is different than the radius of curvature of the blade edge at the second point.

In this way, the radius of curvature of the blade edge at the first point and the radius of curvature at second point are independent one from the other and the shape of the blade can vary according to the production needs. For example, a big radius of curvature may be needed at the area of the gap between the blade and the movable support through which the slurry is cast onto the movable support. A big radius can be foreseen outside the gap to allow the slurry to smoothly approach the gap. Outside the casting area, a small radius can be used to keep the blade dimension to a reasonable size. The shape of the blade is not defined by a single radius of curvature only, but it can be adapted to the production needs using different radii. In this way, the problems present in an apparatus having a cylindrical blade, which has a constant and uniform radius of curvature, can be advantageously avoided.

Preferably, the radius of curvature at the first point and the radius of curvature at the second point are both comprised between about 1 mm and 500 mm, more preferably, between about 3 mm and about 100 mm, most preferably, between about 5 mm and about 50 mm. Preferably, the first radius is between about 1 mm and about 50 mm and the second radius is between about 10 mm and about 500 mm, more preferably, the first radius is between about 3 mm and about 25 mm and the second radius is between about 15 mm and about 100 mm, most preferably, the first radius is between about 5 mm and about 25 mm and the second radius is between about 20 mm and about 50 mm. Preferably, the first radius and the second radius differ from each other by between about 5 mm and about 100 mm, more preferably, the first radius and the second radius differ from each other by between about 10 mm and about 50 mm, most preferably, the first radius and the second radius differ from each other by between about 15 mm and about 30 mm. These radii of curvature have been found to be particular suitable for the realization of a casting blade for the production of cast web of homogenized tobacco material.

In the present specification, the radius of curvature, called R for short, of a curve at a point—such as the radius of curvature of the blade edge at the first and second point—is defined as a measure of the radius of the circular arc which best approximates the curve at that point. It is the inverse of the curvature.

In the case of a plane curve, then the radius of curvature is indicated with R and it indicates the absolute value of $$R \equiv \left|\frac{1}{\kappa}\right| = \frac{ds}{d\varphi},$$

where s is the arc length from a fixed point on the curve, φ is the tangential angle and κ is the curvature.

If the curve defined by the blade edge in the sectioning plane (X, Z) is given in Cartesian coordinates as z(x), then the radius of curvature is (assuming the curve is differentiable up to order two):

$$R \equiv \left|\frac{(1+z'^2)^{3/2}}{z''}\right|$$

$$\text{where } z' = \frac{dz}{dx},\ z'' = \frac{d^2z}{dx^2}.$$

Advantageously, the blade edge comprises a first arc of circumference having said first radius of curvature and a second arc of circumference having said second radius of curvature. Alternatively, the blade edge comprises a portion of an ellipse.

The blade edge may include only points having either one of the two radii of curvature or a plurality of many different radii of curvature. In the first case, the blade may include a solid formed by the intersection of two portions of two cylinders, one being defined by the first radius of curvature and the other by the second radius of curvature. In this embodiment, the section of the casting blade along the (X, Z) plane defines a curve comprising an arc of a first circumference, base of the first cylinder having the first radius of curvature, and an arc of a second circumference, base of the second cylinder having the second radius of curvature. Thus, the radius of curvature is constant within the first arc and the second arc. Alternatively, the blade edge may include a portion of an ellipse. An ellipse has a continuously changing radius of curvature, therefore in this embodiment each different point of the portion of ellipse defined by the blade edge has a different radius of curvature. According to the invention, the blade edge may include both one or more arcs of circumference and one or more portions of ellipses.

Preferably, the junction between different portions, for example between arcs of circumference having different radii of curvature or between different portions of ellipses or a portion of ellipse and an arc of circumference is continuous, so that the resulting curve defined by the sectioning plane (X, Z) forming the blade edge is continuous and its first derivative is continuous as well.

Preferably, said second point is located in a bottom part of said casting blade substantially facing said movable support. The second radius of curvature belongs preferably to a portion of the blade that is in proximity of or in contact to the slurry at the moment of casting. Further, the second radius of curvature is relatively "large". A large radius of curvature allows a gentle flow of slurry into the support because a rather narrow gap is present between the support and the casting blade for a certain length. In other words, the gap formed between the casting blade and the support in case the blade has a "large" radius of curvature in the portion facing the support slowly changes dimension in the direction of casting of the web, that is, in the direction in which the movable support moves. In a blade having a relatively large radius of curvature, the distance between the blade and the support is varying of a small quantity along the casting direction. Thus, a well-defined thickness is forced in the slurry for a rather long distance in the support. This allows a minimization of accumulation of agglomerates, which are normally of a greater thickness than the gap present between the blade and the support, and which are thus not able to squeeze through the "long" gap defined by a blade edge having a rather large radius of curvature.

Further, a large radius of curvature in a portion of the blade facing the support allows to reduce the appearance of defects, for example so called "draggers", due to the slow introduction of the slurry onto the support as time is needed to flow thorough the "long and narrow gap" defined between the blade and the support, the size of the gap being longer along the casting direction (the direction the movable support moves) the larger the radius of curvature.

Preferably, where the second radius of curvature is comparatively large, the first radius of curvature is smaller, so that the blade is not too bulky and still easily configurable and adapted to the remaining part of the casting apparatus. Thus, a relatively large and a relatively small radii of curvature combination allows to obtain a blade having the appropriate dimensions for both casting an uniform and defects-minimizing web onto the moving support and for fastening and adjusting the blade to the remaining part of the casting apparatus.

According to a second aspect, the invention relates to method for the production of a cast web of homogenized tobacco material, comprising introducing a slurry of said homogenized tobacco material in a casting box; casting said slurry onto a movable support by means of a casting blade so as to form a cast web; determining a parameter of said cast web or of said slurry; and changing the distance between said casting blade and said movable support as a function of said parameter. In an advantageous embodiment, changing the distance between said casting blade and said movable support as a function of said parameter comprises operating a first, a second and a third actuator coupled to said casting blade in a first, a second and third position, respectively, each of said first, second and third actuator being suitable to change a distance of said casting blade from said movable support in said first, second and third position. The advantages of such a method have been already outlined above with reference to the first aspect of the invention.

Advantageously, the method of the invention includes, before casting said cast web of homogenized tobacco material, fine tuning the distance between said casting blade and said movable support in a plurality of locations, said locations being spaced apart one from the other of a distance comprised between about 5 cm to about 12 cm along a longitudinal width of said casting blade.

Preferably, changing the distance between said casting blade and said movable support as a function of said parameter comprises bending said casting blade into a nonlinear shape. The blade becomes curved, having a concave or a convex form depending on the desired shape of the gap.

In a preferred embodiment, changing the distance between said casting blade and said movable support comprises obtaining an average distance between said casting blade and said movable support comprised between about 0.1 mm and about 2 mm, more preferably, the mean distance between said casting blade and said support is comprised between about 0.2 mm and about 1.5 mm. The thickness of the cast web of homogenized tobacco material is very relevant for the quality and consistency of the finished product. It is desired that the thickness is homogeneous, that is free of any lumps, agglomerates, fibers and coarse particles. The specific design of the casting blade of the invention together with the created gap between blade and support ensure that the slurry is cast in a continuous web of uniform thickness. Further the appearance of breaks along the width and length of the movable support and other defects can be advantageously reduced.

Further advantages of the invention will become apparent from the detailed description thereof with no-limiting reference to the appended drawings.

Figure 10B:
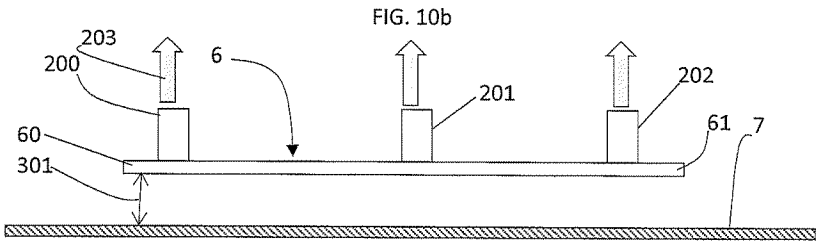
Figure 10D:
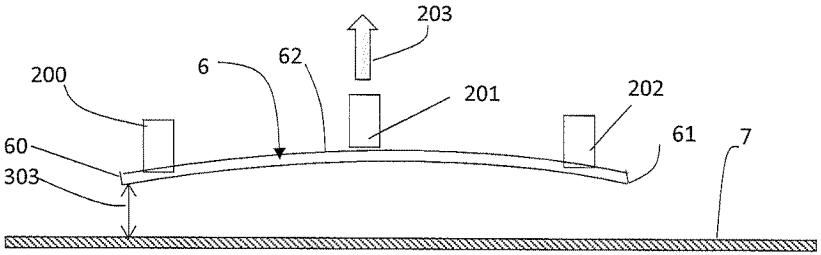
Figure 10A:
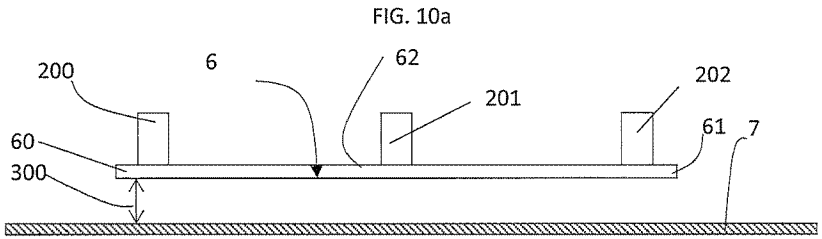
Figure 10C:
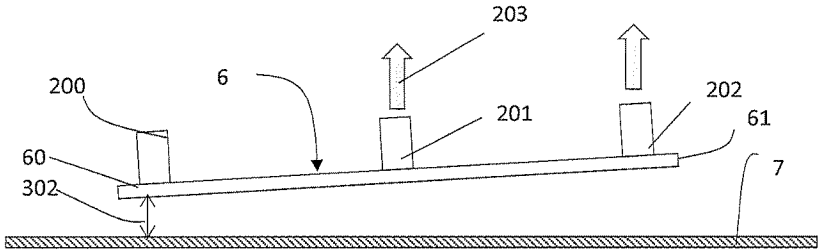
Figure 11:
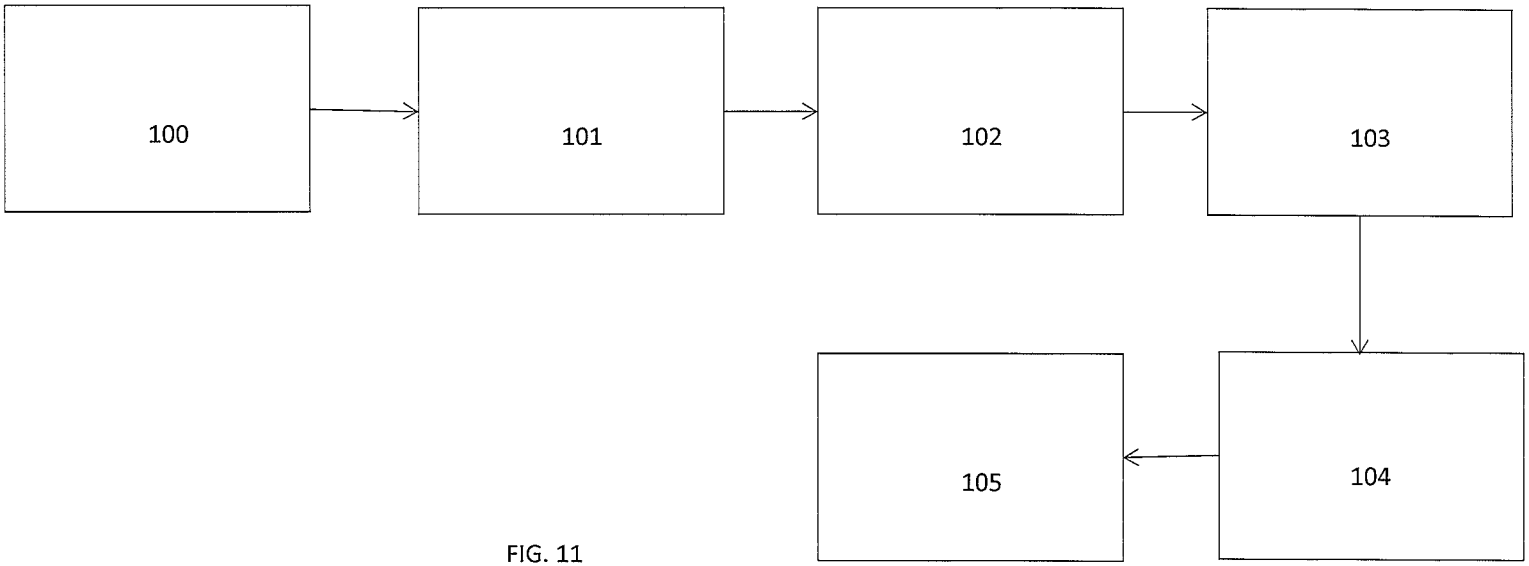

FIGS. 10*a*-10*d* are four front schematic views of a different embodiments of a phase of the method of production of a cast web according to then invention; and FIG. 11 is a flow diagram of a method of production of a homogenized tobacco web using the apparatus of the invention.

Figure 1:
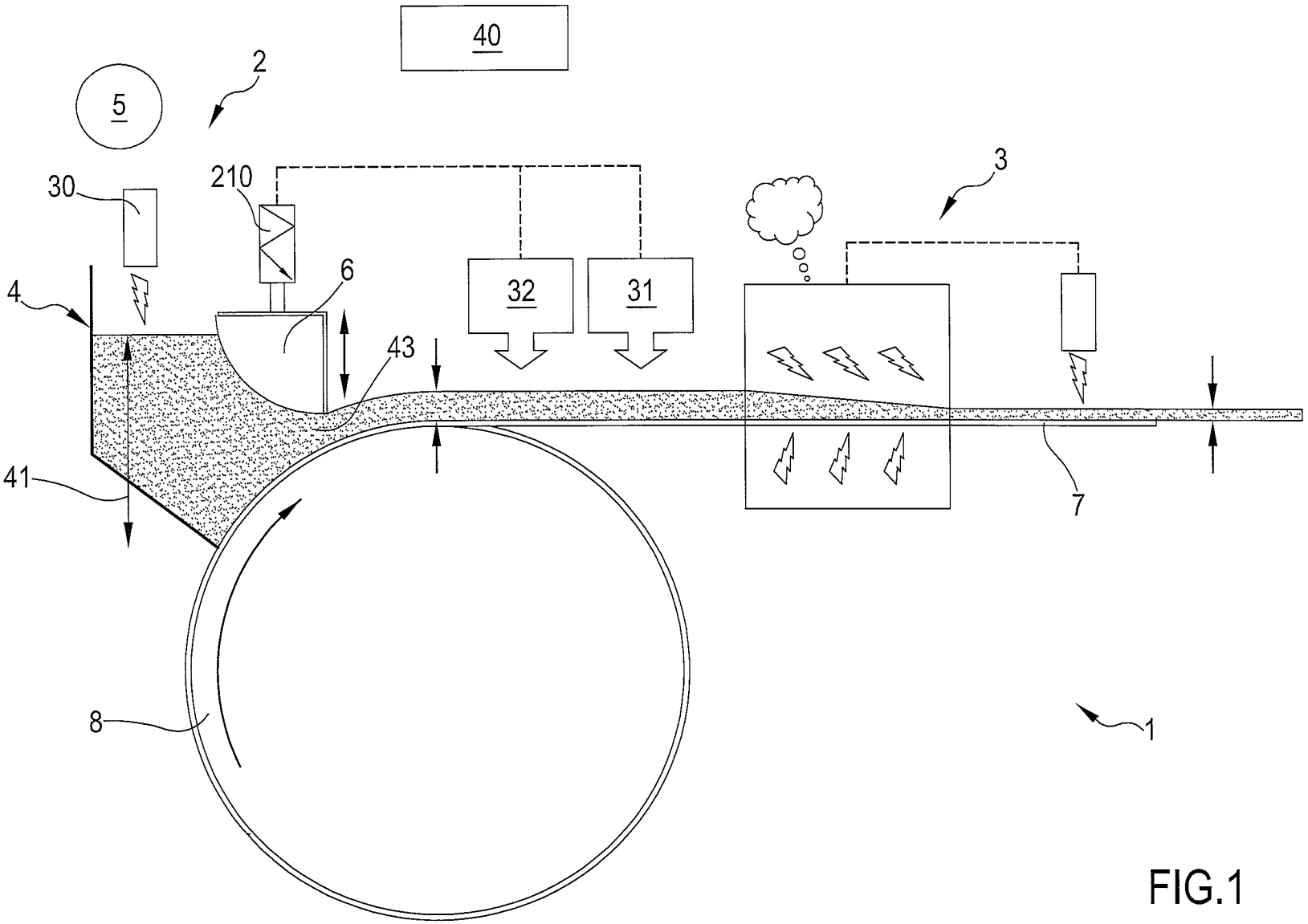
FIG. 1 is a schematic lateral view of an apparatus for the production of a homogenized tobacco web including an apparatus for casting the homogenized tobacco web according to the invention.

With initial reference to FIG. 1, an apparatus for the production of a web of homogenized tobacco material according to the present invention is represented and indicated with reference number 1.

The apparatus 1 for the production of a web of homogenized tobacco material includes a casting apparatus 2 realized according to the present invention and further preferably also a drying apparatus 3 positioned downstream the casting apparatus 2 in the direction of motion of the web of homogenized tobacco material.

The casting apparatus 2 comprises a casting box 4 where slurry to form the web of homogenized tobacco material is introduced, a pump 5, a casting blade 6 and a movable support 7. Casting box 4 may have any geometrical shape, and in the depicted embodiment it is substantially in a form of a prism. The casting box has an opening 43 in correspondence of its bottom and the opening extends along a width of the casting box. Slurry from buffer tanks (not shown in the drawings) is transferred by means of the pump 5 into the casting box. Preferably pump 5 comprises a control (not visible in the drawing) of flow rate to control the amount of slurry introduced in the casting box 4.

Figure 2:
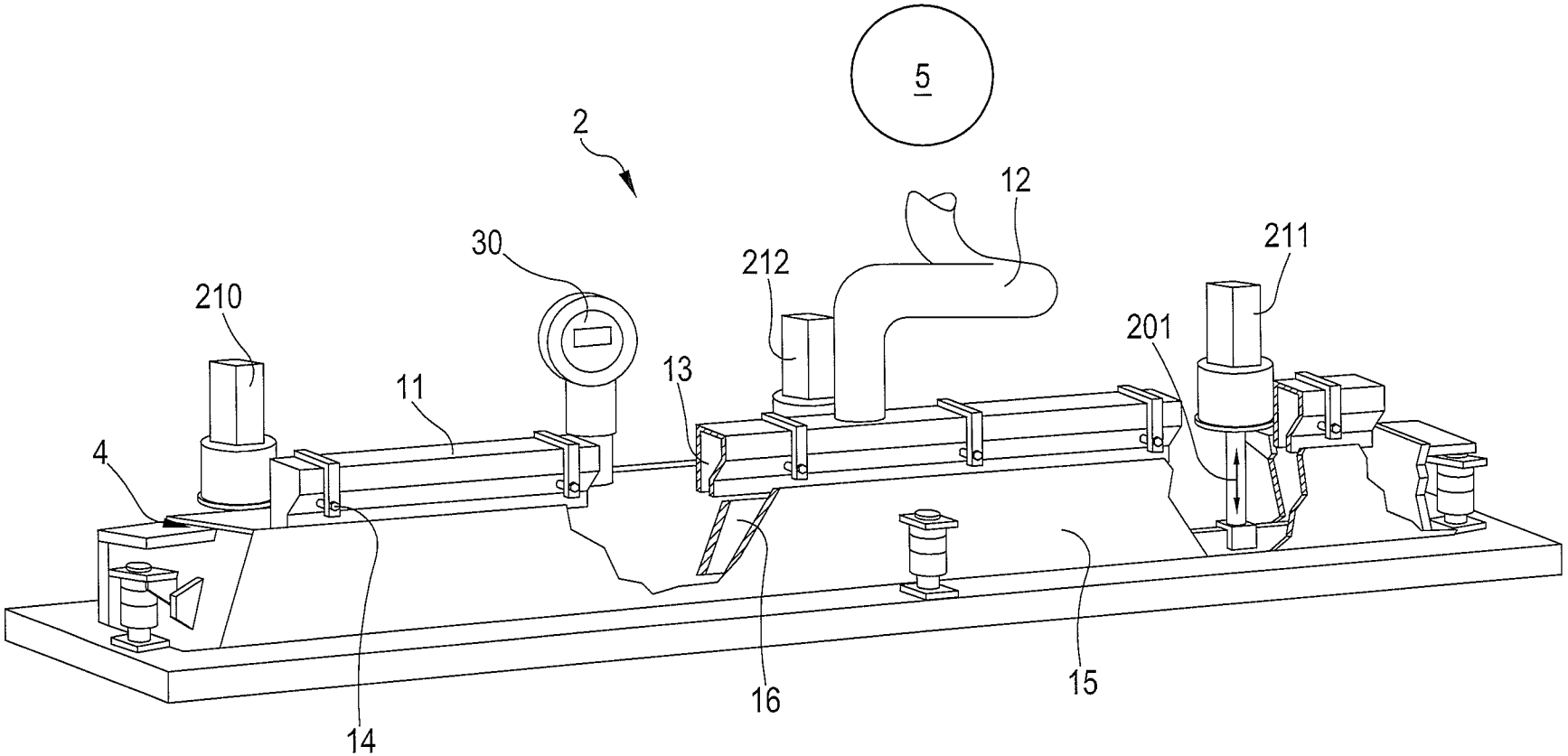
FIG. 2 is a schematic perspective view of a casting apparatus according to the invention.
Figure 3:
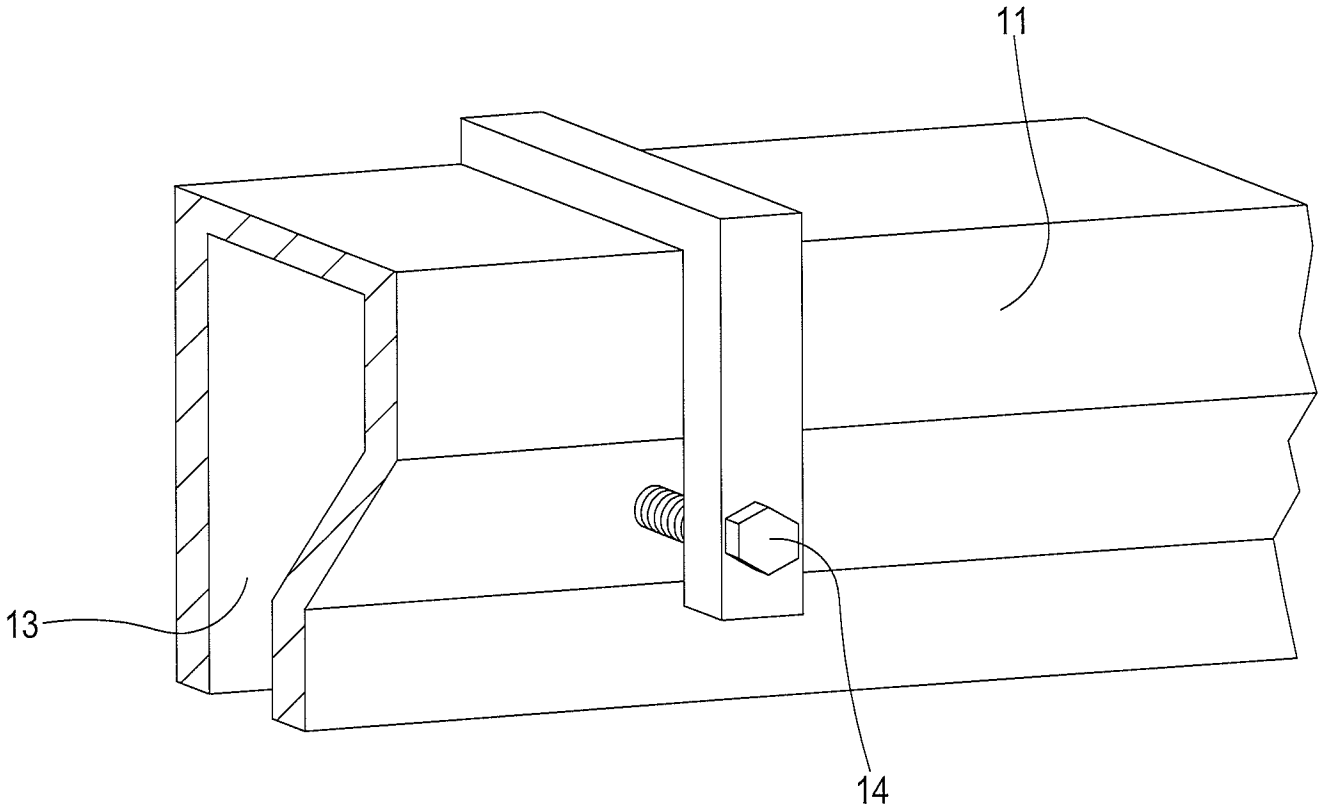
FIG. 3 is an enlarged perspective view of a detail of the casting apparatus of FIG. 2.

Pump 5 is advantageously designed to ensure that slurry transfer times are kept to the minimum necessary. The pump 5 is in fluid communication, for example by means of a tube 12 (visible in FIG. 2), to a distributor 11 of the casting box 4 to distribute the slurry within the casting box 4. Preferably distributor 11 extends along the width of the casting box 4 and it is located above the casting box 4. Distributor 11 includes either a plurality of openings or a single elongated slit (slit 13 visible in FIG. 3) in order to distribute the slurry uniformly along the width of the casting box, so that a filling level 41 of the slurry inside casting box 4 is substantially uniform along the width of the casting box 4. Distributor 11 with elongated slit 13 is better visible in the enlarged view of FIG. 3 where a portion of the distributor can be seen. Preferably, the breadth of the elongated slit 13, that is its dimension perpendicular to its width dimension, is tunable, for example by means of regulating means 14 such as one or more screws, as show in FIG. 3. In this way, the amount of slurry flowing into the casting box 4 from the distributor 11 per unit time can be controlled and adjusted. Therefore, two controls are present of the amount of slurry introduced into the casting box 4, a control on the pump 5 and a control on the distributor 11.

Figure 4:
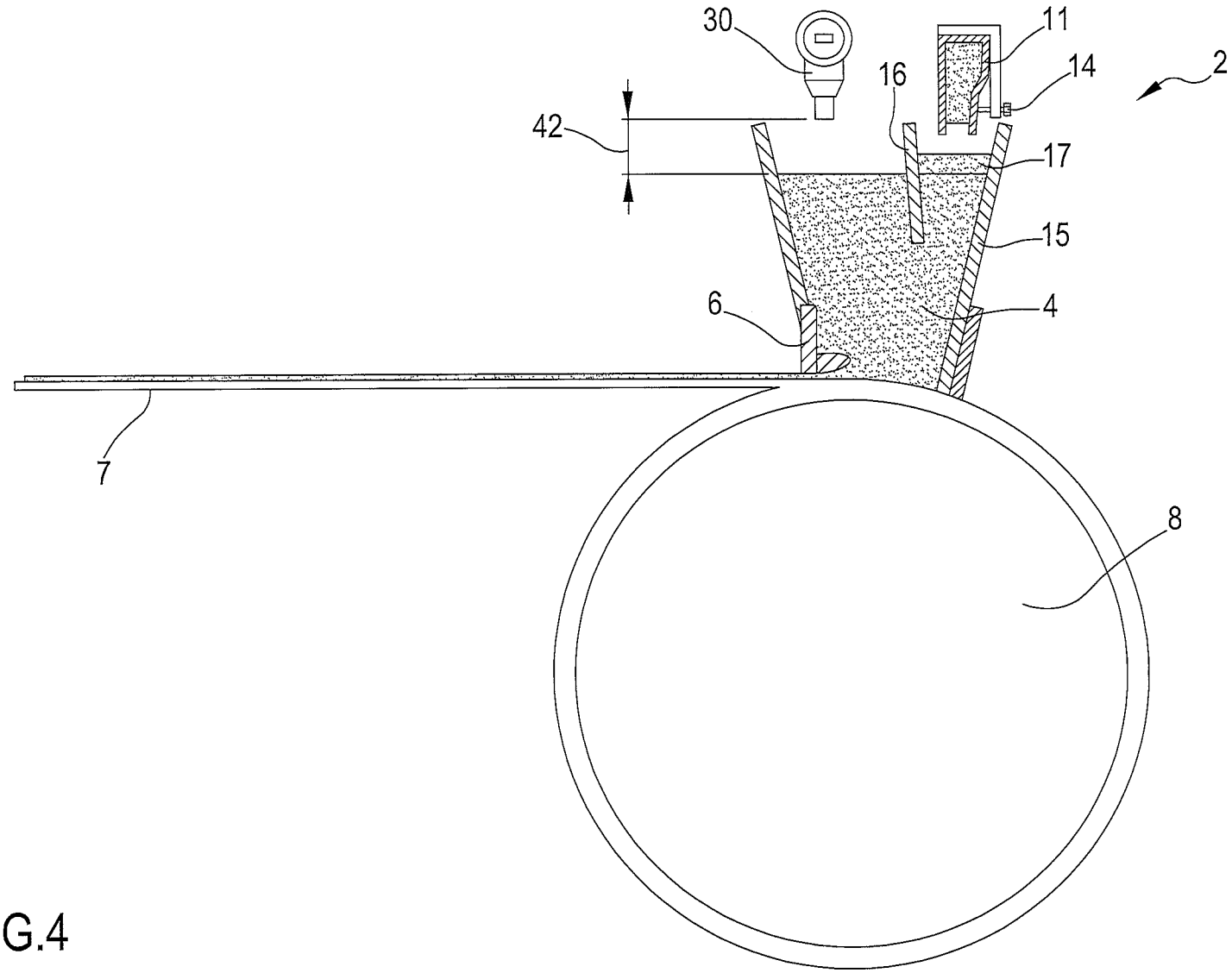
FIG. 4 is a lateral view in section of the casting apparatus of FIG. 2.
Figure 5:
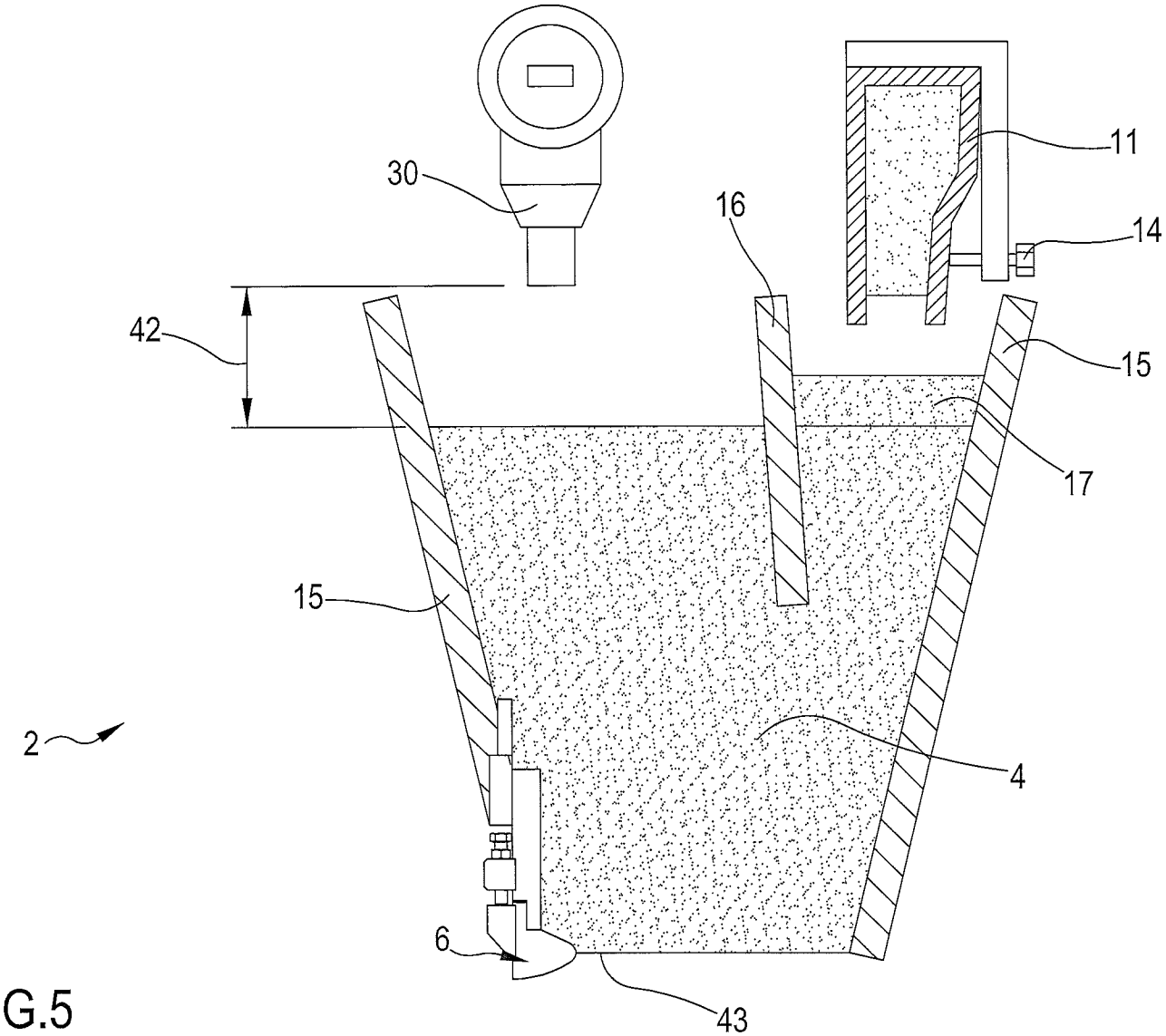
FIG. 5 is an enlarged lateral in section of a portion of the casting apparatus of FIGS. 2 and 4.

Casting box 4, in addition to one or more external walls 15, also further includes an internal wall 16 which delimits a feeding chamber 17 within the casting box 4. The feeding chamber 17 is in fluid communication with the rest of the casting box inner volume. Feeding chamber 17 is located below distributor 11. Due to the high viscosity of the slurry, the height of the slurry in the feeding chamber 17 can be higher than the height of the slurry in the remaining part of the casting box 4. The feeding chamber 17 is better visible in the cross sections of FIGS. 4 and 5.

Further, the casting apparatus 2 includes the casting blade 6 fixed to the casting box 4 in order to cast the slurry. The casting blade 6 has a main dimension which is its width and it is fixed to the casting box 4 at or in proximity of its aperture 43 at the bottom. Preferably, the longitudinal width of the casting blade 6 is between about 40 cm and about 300 cm depending on the desired width of the cast web of slurry. Preferably, such width is adjustable, for example by means of suitable width adjusting means (not visible in the drawings), so that the width of the blade or the active volume of the casting box can be adjusted to the width of the web to be cast. The active volume of the casting box is the volume of the casting box that is actually filled with slurry.

Figure 7:
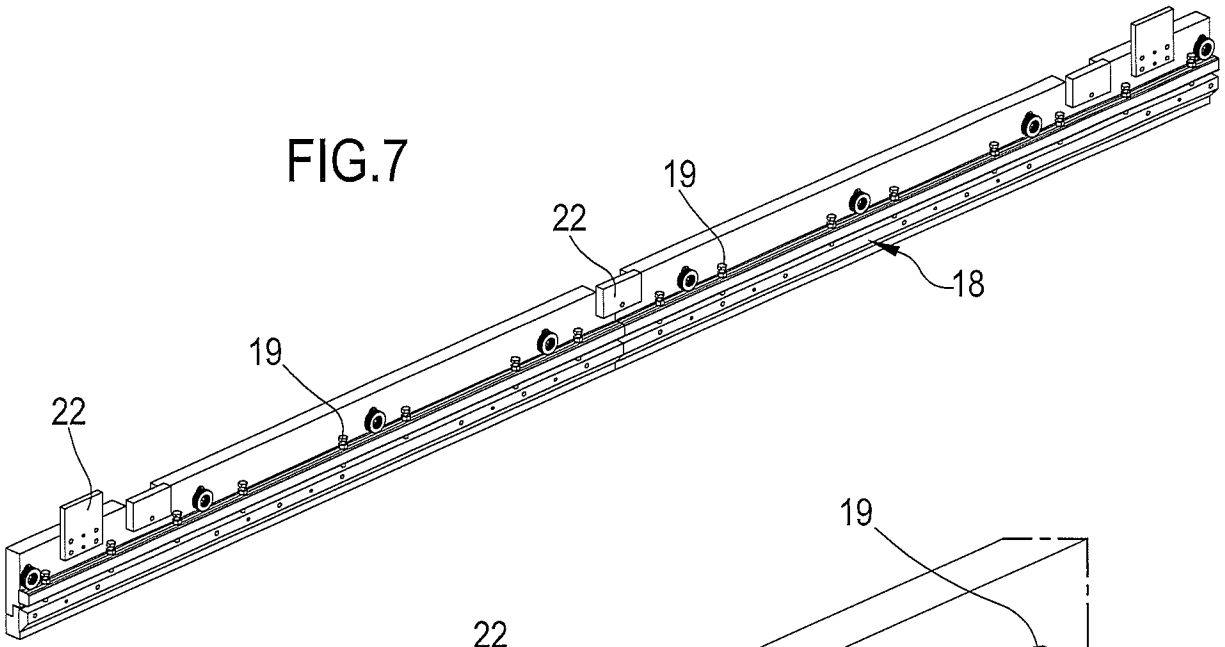
FIG. 7 is a perspective view of another element of the casting apparatus of FIG. 2.
Figure 8:
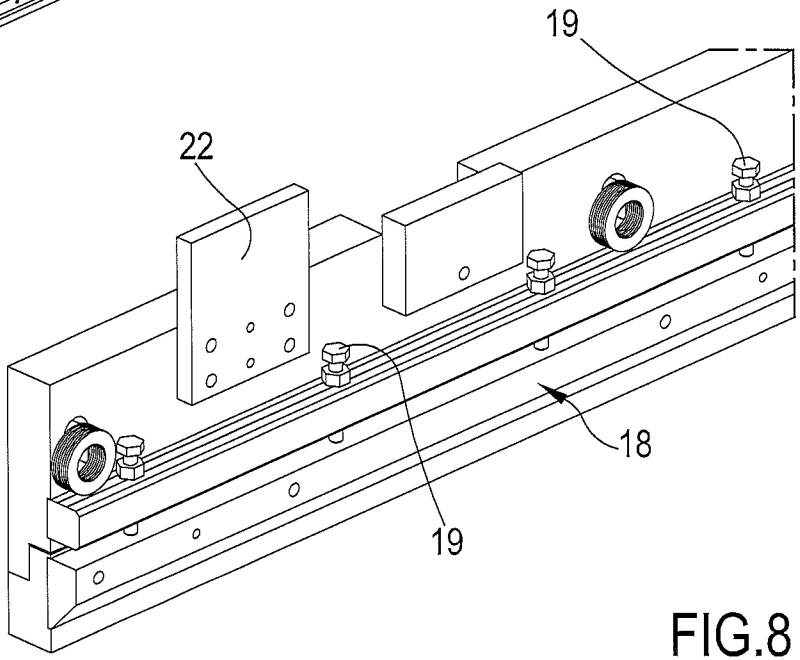
FIG. 8 is an enlarged perspective view of a detail of the element of FIG. 7.
Figure 6:
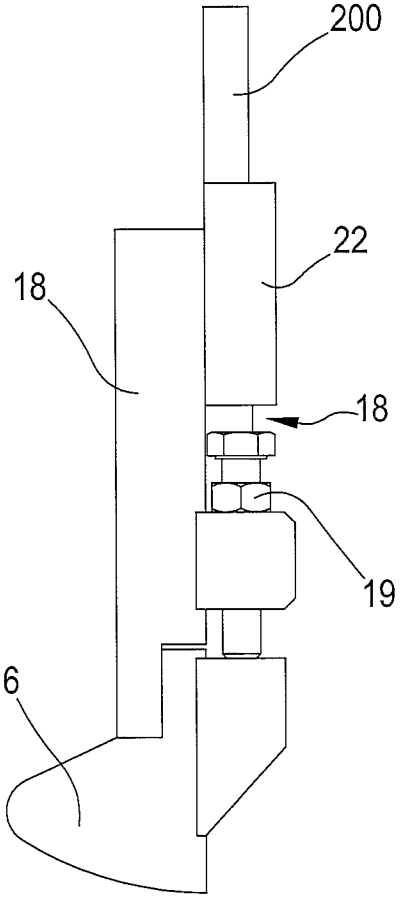
FIG. 6 is a lateral view of an element of the casting apparatus of FIG. 2.

The casting blade 6 is attached to the casting box preferably by means of an adjustable board 18 which allows a precise control of the position of the casting blade 6. Adjustable board 18 is depicted as a whole and in an enlarged view of a detail in FIGS. 7 and 8, respectively. The adjustable board 18 includes a plurality of adjustment elements, all indicated with 19, to adjust a gap between the blade 6 and the support 7. The casting box 4 and the casting blade 6 are mounted above a drum 8 which rotates the movable support 7. Between the casting blade 6 and the movable support 7 a gap is present, the dimensions of which determine—among others—the thickness of the cast web of homogenized tobacco material. Thus, the dimension of the gap is controlled by controlling the position of the casting blade 6 by means of the adjustable board 18 which includes the adjusting elements 19 distributed along its width. Adjusting elements 19 for example include a plurality of screws 19, such as micrometer screws. The width of the adjustable board 18 substantially coincides with the width of the casting blade 6. The adjustable screws 19 are disposed along the width of the adjustable board 18 and can vary the distance locally between the casting blade 6 and the support 7. The distance between any two adjacent screws of the plurality of screws can be pre-set and fixed. Screws 19 are used for the fine adjustment of the casting blade 6 with respects to the movable support 7. Screws 19 can be used to compensate for inhomogeneity of the support surface or of the blade surface. In use, screws 19 are preferably adjusted in a first machine setup. However, the screws 19 may also be actuatable to allow online fine adjustments of the casting blade 6 shape. To further vary the dimension of the gap in the direction perpendicular to its width, that is to vary the breadth of the gap, a plurality of actuators 200, 201, 202 controlled by displacement means, such as motors 210, 211, 212, is connected to the board 18. According to the invention, the number of actuators 200, 201, 202 is equal to or above three. The actuators 200, 201, 202 can be independently controlled, that is, each of the actuators 200, 201, 202 is connected to a respective motor 210, 211, 212. The motors and actuators are connected to the board 18 for example by means of mounts 22 (all mounts indicated with the same reference numeral) protruding outwardly from the board 18. Preferably, each actuator 200, 201, 202 is connected to its own mount 22. Motors 210, 211, 212 therefore may move actuators 200, 201, 202 in order to raise or lower the blade 6. Due to the fact that the actuators 200, 201, 202 can be independently moved, the blade 6 can be locally lowered and raised, to take into account again inhomogeneity of the blade, of the support, and of the slurry. Preferably, the breadth of the gap is comprised between about 0.1 mm and about 2 mm. The connection between the adjustable board 18 and the casting blade 6 is shown in the lateral view of FIG. 6.

The distance among actuators 200, 201, 202, that is the position of each actuator along the width of the blade 6, can also be varied by means of further displacement means, not shown in the drawings.

Figure 9:
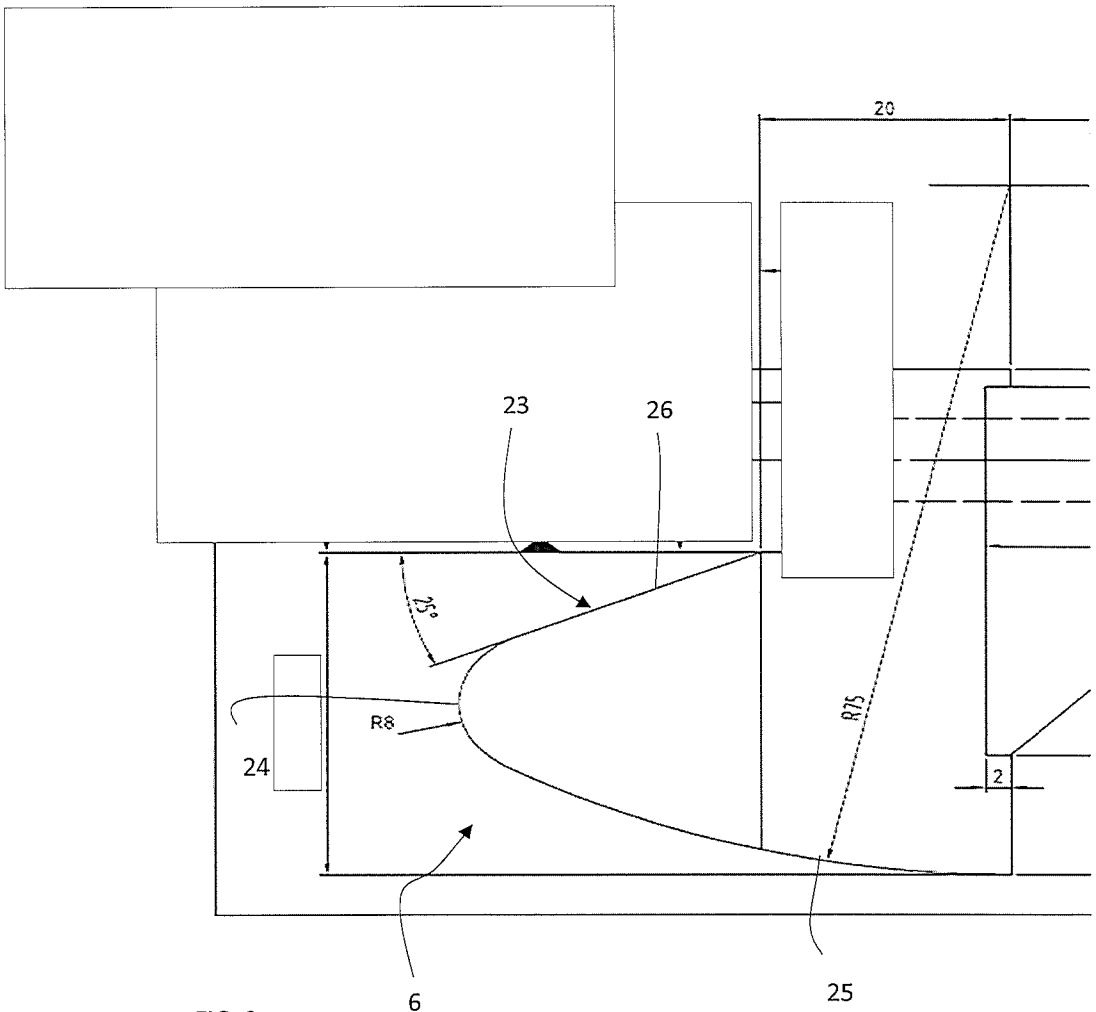
FIG. 9 is a lateral technical drawing of the element of the casting apparatus of FIG. 6.

Further, with now reference to FIG. 9, a section of the casting blade 6 is shown, taken along a plane (X, Z) perpendicular to the width of the casting blade 6. The section of the blade 6 taken along this plane defines an edge 23, which extends along a given curve. This curve includes at least a point 24 having a first radius of curvature and a second point 25 having a second radius of curvature, said first and second radii being between about 1 mm and about 500 mm and being different from each other. In the depicted embodiment, the edge 23 includes a plurality of points 24 all having the first radius of curvature and a second plurality of points all having the second radius of curvature. For example, the edge 23 includes two arcs of circumferences which are continuously connected among them, that is, the two arcs defines a single curve which is continuous and has a continuous first derivative. Alternatively, in an embodiment not depicted, the edge 23 may include a portion of an ellipse. Preferably, the second radius of curvature is wider than the first radius of curvature and the point 25 having the second radius of curvature substantially faces the support 7. In one embodiment, the first radius is between about 5 mm and about 25 mm and the second radius is between about 20 mm and about 50 mm. In the depicted embodiment, the casting blade 6 further includes a third point 26 having a third radius of curvature.

The casting apparatus 2 also comprises the movable support 7 on which the slurry is cast to form the web of homogenized tobacco material. The movable support 7 comprises for example a continuous stainless belt 7 comprising a drum assembly. The drum assembly includes a main drum 8 located below the casting box 4 which moves the movable support 7. Preferably, the casting box 4 is mounted on top of the main drum 8. Preferably, the tolerances of the above mounting are very strict, for example within about 0.01 mm. For example, the movable support drum 8 has a tolerance of below about 0.01 mm in concentricity and below about 0.10 mm across its diameter. The movable support 7 has a tolerance preferably below about 0.01 mm.

The displacement of the blade 6 with respect to the support 7 in order to change the dimension or the shape of the gap are schematically described with reference to FIGS. 10*a*-10*d*. In these drawings, the adjustable board 18 and the adjustment screws 19 are not visible, for clarity reasons. In FIG. 10*a*, the blade 6 and the support 7 are separated by a gap indicated with 300 having uniform dimension, such that the dimension of the gap is substantially uniform along the whole width of the blade 6. The dimension of gap 300 is selected in order to obtain the desired thickness of the cast web for a set of parameters of the casting process. In case the resulting thickness of the cast web is not the desired one, not even within the tolerances range, or it is not uniform, the gap 300 is preferably modified, by means of the actuators 200, 201, 202 coupled to blade 6. Preferably, a first and second actuators 200, 201 are located in a first and second position at or in proximity of opposite distal ends 60, 61 of blade 6, respectively. The third actuator 202 is preferably disposed in a third position there between, that is in a substantially intermediate portion 62 of the blade between the two distal ends 60, 61. The distance between the first and third actuators 200, 202 and the second and third actuators 201, 202 may be the same or different. Further, this distance between the first and third actuators 200, 202 or the distance between the third and the second actuators 201, 202 can be changed. The three actuators 200, 201, 202 are operated by three separate motors 210, 211, 212 not visible in drawings 10*a*-10*d* (motors 210, 211, 212 are visible in FIG. 2).

In order to change the gap dimension or shape, in a first embodiment of the invention, the gap 300 is modified as shown in FIG. 10*b*. In order to obtain a new gap 301 having a different dimension as shown in FIG. 10*b*, all actuators 200, 201, 202 are operated and the blade 6 is substantially displaced in a substantially vertical direction. For example, where the gap dimension needs to be increased, the gap may be enlarged by displacing the blade 6 from the support 7, as indicated in FIG. 10*b* by arrows 203 pointing away from the support 7. Each arrow 203 indicates the movement of the corresponding actuator 200, 201 or 202. The resulting new gap 301 has a dimension which is bigger than the dimension of the original gap 300 and it is preferably uniform, that is the dimension of the gap between the blade 6 and the support 7 is the same for the whole longitudinal width of the blade 6. In this case, the relevant dimension of the gap is the vertical dimension along the Z axis.

Alternatively, in case of a non-uniform casting thickness of the cast web, or irregularities in the blade, in the support, or in the distribution of the slurry in the casting box, the gap 300 of FIG. 10*a* is preferably modified in a non-uniform or asymmetric manner. Different modifications are possible. For example, as depicted in FIG. 10*c*, the dimension of the gap is maintained in proximity of one distal end 60 of the blade 6, and the gap is increased in proximity of the opposite distal end 61. The second and third actuators 201, 202 are then controlled for example by their respective motors 211, 212 (not visible in the drawings 10*a*-10*d*), so that one end 61 of the casting blade 6 is moved upwards according to arrows 203, forming a substantially "wedge-like" gap 302, having a non-uniform dimension along the Z axis. This way, a gap having a smaller dimension on one end 60 of the blade 6 and a wider dimension on the opposite end 61 of the blade 6 is created. A similar result, in particular if a small difference in the gap dimensions at the two opposite ends of the blade is to be obtained, can be achieved by actuating only the second actuator 202. Alternatively, all three actuators are operated, and the blade is displaced in all first, second and third positions, however the displacement in each position is not the same, but the displacement in the first position is different than the displacement in the second position and than the displacement in the third position.

In an additional embodiment depicted in FIG. 10*d*, the gap 300 of FIG. 10*a* is substantially modified bending the blade 6 so that the so formed new gap 303 in the intermediate portion 62 of the blade has a wider dimension than the gap at the distal ends 60, 61 of the blade 6. In this case, only the third actuator 202 located at the intermediate portion 62 is operated and displaced. In this way, the blade 6 can have an arc-like configuration, as depicted in FIG. 10*d*. This configuration can be obtained also operating all three actuators 200, 201 and 202, but wherein the displacement of the third actuator 202 in the middle position is greater than the displacements performed by the first and second actuators 200, 201 in the first and second positions. This configuration has been found to be especially advantageous where a non-uniform temperature distribution of the movable support is observed, in particular, where the temperature along the center of the movable support is higher than towards the transverse sides of the movable support.

Further, with reference to FIG. 1, the casting apparatus 2 includes a plurality of sensors. A first slurry level sensor 30 is adapted to control the height 41 of the slurry within the casting box 4. This sensor 30 preferably measures a distance 42 between the sensor itself and the surface of the slurry in the casting box 4 (see FIG. 5). The height 41 of the slurry is then derived from the known distance between the sensor 30 and the bottom of the casting box 4. Further, preferably additional sensors 31, 32 are arranged above the movable support 7 to measure the weight per square centimeter and the thickness of the homogenized tobacco web on the movable support 7. The sensor 31 may be for example a nucleonic measuring head. Additional sensors, not shown in the drawings, are preferably present as well, such as a sensor to locate and determine the positions of defects in the cast web of homogenized tobacco, a sensor to determine the moisture of the slurry and of the cast leaf at casting, and a temperature sensor for determining the temperature of the slurry in the casting box 4.

Preferably, all the sensors send signals relative to their respective parameters to be measured (for example temperature, moisture slurry level or position of defects) to a central control unit 40. Central control unit 40 is preferably electrically connected to one, to some or to all of pump 5, motors 210, 211, 212 or to further circuits and actuators in the casting apparatus 2 or in a slurry preparation apparatus (not visible). In case the cast web reveals defects or inhomogeneity or the characteristics of the cast web are outside a preset range, the central control unit 40 can instruct changes in the process parameters and thus influence characteristics of the slurry or the parameters of the casting. These process parameters may be for example the dimension of the gap between the casting blade 6 and the support 7 or the amount of slurry in the casting box 4. For example, a feedback loop to the actuators 200, 201, 202 of the casting blade 6 is present to adjust the thickness of the cast web.

The control unit 40 therefore sends signals to the motors 210, 211, 212 or to the actuators 200, 201, 202 directly to control the actuators to change the position of the blade and thus the dimension of the gap between the casting blade 6 and the movable support 7. Depending on the requirements, the signal sent by the control unit 40 may instruct the actuators 200, 201, 202 to move according to any of the configurations of FIGS. 10*b*-10*d* or any different configuration depending on the detected parameters.

Preferably, a continuous feedback from the sensors to the control unit 40 is sent, so that the actuators or motors are operated till the casting blade 6 is positioned in such a way that the desired thickness and characteristics of the cast web are obtained, as sensed by sensors 30, 31, 32 or others.

Preferably, the drum or roller 8 includes a temperature control device (not shown). The main drum 8 of the support 7 where the casting box 4 is located is preferably maintained at a constant temperature to allow precise predictions about the aging of the slurry. However, it may be desired that the drum 8 has a varying temperature profile across the drum 8 that is constant in time. For example, the temperature in the middle of the surface of the drum 8 may be between about 0.5 degrees and about 10 degrees higher than the temperature at the ends of the drum. This temperature is substantially similar to the temperature of the slurry present in the casting box 4 that is a temperature between about 5 degrees Celsius and about 26 degrees Celsius. Preferably, the temperature of the movable support 7, such as the stainless steel belt 7, on entering the casting box 4 remains substantially constant across the width of the belt. To ensure the belt and drum temperatures are optimal for the slurry, the temperature control device recirculate process water which is put in contact with the movable support 7 and the drum 8 on the return side.

The drying apparatus 3 includes a plurality of individual drying zones. Each drying zone preferably includes steam heating on the bottom side of the support and heated air above the movable support 7 and preferably also adjustable exhaust air control. Within the drying apparatus 3, the homogenized tobacco web is dried to desired final moisture on the support 7.

With now reference to FIG. 11, the functioning of the apparatus 1 including the casting apparatus 2 of the invention is as follows. A slurry, formed preferably mixing and combining tobacco powder and other ingredients, is transferred from a holding tank (not shown) using for example in line mixers (also not shown) to the casting apparatus 2 inside the casting box 4. The step 100 of casting of the slurry into a web of homogenous and uniform film thickness is performed on the movable support 7, for example the stainless steel belt 7. The casting step 100 includes transferring the slurry from the mixing tank to the casting box 4. Further, it preferably includes monitoring the level of slurry in the casting box 4, the moisture of the slurry inside the casting box 4, and the density of the slurry, by means of suitable sensors, such as sensor 30.

The thickness of the web of homogenized tobacco material and grammage controlled by nucleonic gauge immediately after casting are continuously monitored and feedback-controlled. The casting is performed by means of casting blade 6 forming a gap with the movable support 7, wherein the dimensions of the gap can also be feedback controlled. The shape of the casting blade 6 including two different radii of curvature in its edge 23 allows the reproducible formation of a substantially uniform web homogenized tobacco.

Further, the cast web undergoes a drying step 101 by means of the drying apparatus 3. The drying step includes preferably a uniform and gentle drying of the cast web in an endless, stainless steel belt dryer with individually controllable zones. During the drying, a monitoring step 102 of the cast web temperature at each drying zone to ensure a gentle drying profile at each drying zone is preferably performed. The cast web is dried to desired final moisture on the steel belt 7 with steam pan heating from bottom and top air drying. Every drying zone is equipped with steam flow and pressure control and air temperature and air flow are fully adjustable to provide the desired drying profile and ensuring product residence time is respected. Preferably, a TLC drying profile is employed.

Preferably, at the end of the casting step 100 and of the drying step 101, the homogenized tobacco web is removed from the support 7. Doctoring 103 of the cast web after the drying station at the right moisture content is preferably performed. The cast web goes preferably through a secondary drying process 104 to remove further moisture content of the web to reach moisture target or specification. Preferably, in this second drying step, the cast web is laid onto a wire, such that moisture can be easily removed from both surfaces of the web. After the drying step 101, 104, the cast web is preferably wound in one or more bobbins in a winding step 105, for example to form a single master bobbin. This master bobbin may be then used to perform the production of smaller bobbins by slitting and small bobbin forming process. The smaller bobbin may then be used for the production of an aerosol-generating article (not shown).

The invention claimed is:

1. Casting apparatus for the production of a cast web of homogenized tobacco material, said casting apparatus comprising a casting box adapted to contain a slurry of said homogenized tobacco material;

a movable support;

a casting blade adapted to cast said slurry contained in said casting box onto said movable support in order to form the cast web;

wherein said casting apparatus further comprises a first, a second and a third actuator coupled to said casting blade in a first, a second and third position, respectively, said first, second and third actuator being suitable to change a distance between said casting blade and said movable support in said first, second and third position, respectively.

2. Casting apparatus according to claim 1, wherein said first, second and third actuator are so configured that they can be actuated to change said distance between said casting blade and said movable support in said first, second and third position, respectively, independently one from the others.

3. Casting apparatus according to claim 1, wherein said first and second position are located at a first and at a second longitudinal end of said casting blade, respectively, and said third position is located in between said first and second longitudinal end of said casting blade.

4. Casting apparatus according to claim 1, further comprising a transverse displacement element that allow the transverse displacement of at least one of the first, second, or third position of said first, second or third actuator along said casting blade.

5. Casting apparatus according to claim 1, comprising a plurality of fine adjustment elements coupled to said casting blade, each fine adjustment element being adapted to locally vary the distance between said casting blade and said movable support, said fine adjustment element being located along a longitudinal width of said casting blade, a fine adjustment element every about 5 cm to about 12 cm.

6. Casting apparatus according to claim 5, wherein at least one of said fine adjustment element is adapted to locally vary the distance between said casting blade and said movable support of a value comprised between about 1 μm and about 200 μm.

7. Casting apparatus according to claim 5, wherein said fine adjusting elements comprise screws which are adapted to, when screwed or unscrewed, lower or rise said casting blade with respect to said movable support, respectively.

8. Casting apparatus according to claim 1, comprising:

a sensor, and a control unit adapted to send signals to or receive signals from said sensor and to send signals to or receive signals from said first, second and third actuators, said sensor being adapted to detect a parameter of said cast web or of said slurry and send a corresponding signal to said control unit which in turn is adapted to send a command signal to said first, second or third actuator to operate said first, second, or third actuator, respectively.

9. Casting apparatus according to claim 1, comprising a control unit and one or more sensors adapted to send signals to said control unit, said one or more sensors comprising:

a sensor to identify draggers on the cast web cast on the movable support;

a sensor to determine the moisture of said cast web cast on the movable support;

a sensor to measure the thickness or variations in thickness of said cast web cast on the movable support;

a sensor to measure the viscosity of the slurry in said casting box;

a sensor to measure the temperature of said slurry in said casting box;

a sensor to detect the position of defects on said cast web cast on the movable support;

a sensor to detect the density of the slurry in said casting box;

and combinations of two or more of the above sensors.

10. Casting apparatus according to claim 9, wherein the control unit is adapted to command the first, second or third actuator in response to a signal received from one or more of said sensors in order to perform a feedback loop to vary one or more of the parameters detected by said one or more sensors in response to said signal.

11. Casting apparatus according to claim 1, wherein said casting blade has a transverse cross section defining a blade edge, said blade edge comprising a first arc of circumference having a first radius of curvature and a second arc of circumference having a second radius of curvature or said blade edge comprising a portion of an ellipse.

12. A method for forming a cast web of homogenized tobacco material, comprising Introducing a slurry of said homogenized tobacco material in a casting box;

Casting said slurry onto a movable support with a casting blade so as to form a cast web;

Determining a parameter of said cast web or of said slurry; and

Changing the distance between said casting blade and said movable support as a function of said parameter;

wherein changing the distance between said casting blade and said movable support as a function of said parameter comprises operating a first, a second and a third actuator coupled to said casting blade in a first, a second and third position, respectively, each of said first, second and third actuator being suitable to change a distance of said casting blade from said movable support in said first, second and third position.

13. Method according to claim 12, comprising, before casting said cast web, Fine tuning the distance between said casting blade and said movable support in a plurality of locations, said locations being spaced apart one from the other of a distance comprised between about 5 cm to 12 cm along a longitudinal width of said casting blade.

14. Method according to claim 12, wherein determining a parameter of said casting web or of said slurry comprises one or more of:

detecting the presence of draggers on said cast web;

determining the moisture of said cast web cast on the movable support;

measuring the thickness or variations in thickness of said cast web cast on the movable support;

measuring the viscosity of the slurry in said casting box;

measuring the temperature of said slurry in said casting box;

detecting the presence of defects on said cast web cast on the movable support;

detecting the position of defects on said cast web cast on the movable support;

detecting the density of the slurry in said casting box;

and combinations of two or more of the above.

15. Method according to claim 12, wherein changing the distance between said casting blade and said movable support as a function of said parameter comprises Bending said casting blade into a nonlinear shape.

16. Method according to claim 12, wherein changing the distance between said casting blade and said movable support comprises obtaining an average distance between said casting blade and said movable support comprised between about 0.1 mm and about 2 mm.

* * * * *